US005350256A

United States Patent [19]

Hammer

[11] Patent Number: 5,350,256

[45] Date of Patent: Sep. 27, 1994

[54] INTERLOCKING RETAINING WALLS BLOCKS AND SYSTEM

[75] Inventor: James Hammer, Portland, Oreg.

[73] Assignee: Westblock Products, Inc., Portland, Oreg.

[21] Appl. No.: 798,120

[22] Filed: Nov. 26, 1991

[51] Int. Cl.[5] ..... E02D 27/00; E02D 29/00; E02D 5/00

[52] U.S. Cl. ..... 405/286; 405/284; 405/262; 52/570; 52/599; 52/604; 52/605; 52/606; 52/612; 52/426

[58] Field of Search ..... 52/562, 564, 565, 570, 52/586, 587, 588, 589, 591, 593, 595, 596, 598, 599, 604, 605, 606, 612, 422, 424, 425, 427, 284; 405/286, 284, 277, 275, 273, 262

[56] References Cited

U.S. PATENT DOCUMENTS

| | | | |
|---|---|---|---|
| 250,635 | 12/1881 | McLean | 405/284 X |
| 868,838 | 10/1907 | Brewington | 52/591 |
| 994,027 | 5/1911 | O'Beirne | 52/564 |
| 1,188,919 | 6/1916 | England | 52/564 |
| 1,226,214 | 5/1917 | Hopkins | 52/427 |
| 1,329,893 | 2/1920 | Flynn | 52/562 |
| 1,627,986 | 5/1927 | McKenzi | 52/570 |
| 1,985,992 | 1/1935 | Hayman . | |
| 2,016,382 | 10/1935 | Burney | 52/270 |
| 2,589,304 | 3/1952 | Spander | 52/591 X |
| 2,619,829 | 12/1952 | Tatum | 52/591 |
| 3,464,211 | 9/1969 | Andreses | 52/587 X |
| 3,877,236 | 4/1975 | O'Neill et al. | 405/273 |
| 4,003,172 | 1/1977 | Pawl | 52/605 X |
| 4,190,384 | 2/1980 | Neumann . | |
| 4,278,364 | 7/1981 | Frehner . | |
| 4,379,659 | 4/1983 | Steiner . | |
| 4,384,810 | 5/1983 | Neumann . | |
| 4,470,728 | 9/1984 | Broadbent . | |
| 4,490,075 | 12/1984 | Risi et al. . | |
| 4,512,685 | 4/1985 | Hegle . | |
| 4,597,236 | 7/1986 | Braxton | 52/564 |
| 4,661,023 | 4/1987 | Hilfiker . | |
| 4,782,640 | 11/1988 | Scheiwiller . | |
| 4,884,378 | 12/1989 | Scheiwiller . | |
| 4,896,999 | 1/1990 | Ruckstuhl . | |
| 4,914,876 | 4/1990 | Forsberg . | |
| 4,922,678 | 5/1990 | Scheiwiller . | |
| 4,982,544 | 1/1991 | Smith | 52/606 |

FOREIGN PATENT DOCUMENTS

| | | | |
|---|---|---|---|
| 2544196 | 4/1977 | Fed. Rep. of Germany | 52/604 |
| 2549162 | 5/1977 | Fed. Rep. of Germany . | |
| 3118487 | 11/1982 | Fed. Rep. of Germany . | |
| 2605661 | 4/1988 | France . | |
| 1348253 | 4/1971 | United Kingdom . | |
| 2068434 | 8/1981 | United Kingdom . | |

OTHER PUBLICATIONS 6-page brochure from GEOdynamics Erosion Control Systems, Indianapolis, Ind.

4-page brochure from Risi Stone Ltd., Gormley, Ontario, Canada, entitled DURA-CRIB®, 1985.

2-page brochure from Risi Stone Ltd., Gormley, Ontario, Canada, entitled DURA-HOLD®, 1985.

*Primary Examiner*—Carl D. Friedman
*Assistant Examiner*—Robert J. Canfield
*Attorney, Agent, or Firm*—Klarquist Sparkman Campbell Leigh & Whinston

[57] ABSTRACT

A retaining wall system is constructed in several distinct layers. Each layer is formed of a side-by-side arrangement of I-shaped subassemblies with backfill chambers defined between each pair of subassemblies. Each subassembly is constructed of generally planar elongated concrete blocks which interconnect to laterally secure the blocks to one another. Interconnections are provided by dovetail joints in which a tongue is vertically slid into a groove to prevent lateral separation. The dovetail elements extend only partially across the face of each block so that the block defining the groove is not excessively weakened by the groove.

19 Claims, 2 Drawing Sheets

INTERLOCKING RETAINING WALLS BLOCKS AND SYSTEM

TECHNICAL FIELD

This invention relates to construction blocks and structures made therefrom, and more particularly to retaining wall blocks and retaining walls for retaining slopes of earth.

BACKGROUND OF THE ART

Conventional retaining walls are used to secure earth embankments against sliding and slumping. Retaining walls are made of various materials such as concrete, solid masonry, wood ties, bricks and blocks of stone and concrete. Typically, blocks are placed in rows overlaying on top of each other to form a wall. An example of such a system is shown in U.S. Pat. No. 4,914,876 to Forsberg, which shows each block having a decorative exterior face so that the wall presents an attractive appearance. For taller walls, a horizontal tie-back sheet must be located between lower layers of blocks, anchored to pins in the blocks, and extended rearwardly into an excavated area to be backfilled for retaining the lower portions of the wall against the outward force of the earth being retained. Because excavation is costly, and the tie-back sheet must extend rearward at least ⅔ of the wall height, this type of wall often is not cost effective. Also, where a single thickness of blocks must retain the earth, each block must be of appreciable size and weight, making handling for installation difficult. In addition, because different face textures are required for different applications, a variety of entirely different blocks must be fabricated and stocked.

To avoid the disadvantages of the heavy unitary blocks of Forsberg and the cost of the tie-back sheet, which requires substantial earthmoving and careful filling and grading of one layer at a time, walls systems having interlocking subcomponents have been employed.

Such a system is shown in U.S. Pat. No. 4,896,999 to Ruckstuhl. In this system, a frontal or face block is attached at its rear surface with a single connecting or anchoring block, or with blocks that may extend in lateral layers deep into the slope to anchor the wall. In such an arrangement, each layer that extends laterally into the slope is a substantially solid layer formed of blocks that do not easily slide apart. To provide adequate anchoring, such anchoring layers are spaced apart, with slope material backfilled between the layers. Each layer of backfill material must be carefully graded so that the anchoring layer installed on top of the backfill is substantially even, preventing vertical misalignments that may weaken or disengage the blocks.

Another concrete block wall system also using mechanical connections is shown in U.S. Pat. No. 4,884,378 to Scheiwiller. This system is used for free-standing walls and vertical retaining walls. No anchoring layers are provided because reinforced vertical beams are cast as part of the structure, with external blocks attached to the structure by dovetail joints. In Scheiwiller, the face blocks are attached to vertical columns. Therefore, sloped and sinuous wall structures may not be formed because such structures require that each succeeding layer be laterally offset in places relative to the layer on which it rests.

A further disadvantage of concrete block systems having mechanically attached blocks is that the individual blocks are weakened by the dovetail joints used, and may easily break. This is particularly a problem in blocks having a dovetail groove or slot that reduces the thickness of a planar block, such as shown in Scheiwiller.

SUMMARY OF THE INVENTION

The primary objects of the invention are to provide:

1. A retaining wall system employing units of a size that may easily be manipulated during construction.
2. A system as aforesaid in which the block units are securely anchored in a slope without requiring substantial excavation of the slope for installation.
3. A system as aforesaid in which the blocks are aligned to provide accurate vertical positioning.
4. The system as aforesaid in which a substantial portion of blocks are standard elements that may be used regardless of the desired appearance of the wall surface.
5. The system as aforesaid in which the textured surface elements may be removed and replaced.
6. The system as aforesaid in which the blocks are configured to resist breakage at their interconnections.

According to the present invention, the primary objects are achieved by providing a retaining wall system having interlocked blocks connected by dovetail joints of compatible male and female genders to define a backfill chamber for filling with material to anchor the blocks in a slope. The blocks are generally thin and planar and connected to form I-shaped subassemblies.

Each subassembly includes a textured face block oriented parallel to the face of the slope, a trunk block extending perpendicularly from the rear of the face block into the slope, and a tail block connected to the trunk block and generally parallel to the face block. Additional trunk and tail blocks may be included in a subassembly to extend deeper into the slope for added anchoring strength. Adjacent subassemblies define backfill chambers between the trunk blocks, with the face and tail blocks forming the front and rear walls of the backfill chambers.

Each dovetail joint connecting two blocks extends only partially across the largest, or primary face of each block so that the blocks have a stop to ensure accurate vertical alignment. The joint does not fully span the primary face. Additionally, this provides strength to the blocks having female dovetail grooves by providing an uninterrupted portion of the slotted surface to resist breakage.

The foregoing and additional features and advantages of the present invention will be more readily apparent from the following detailed description which proceeds with reference to the accompanying drawings.

DETAILED DESCRIPTION OF A PREFERRED EMBODIMENT

Figure 1:
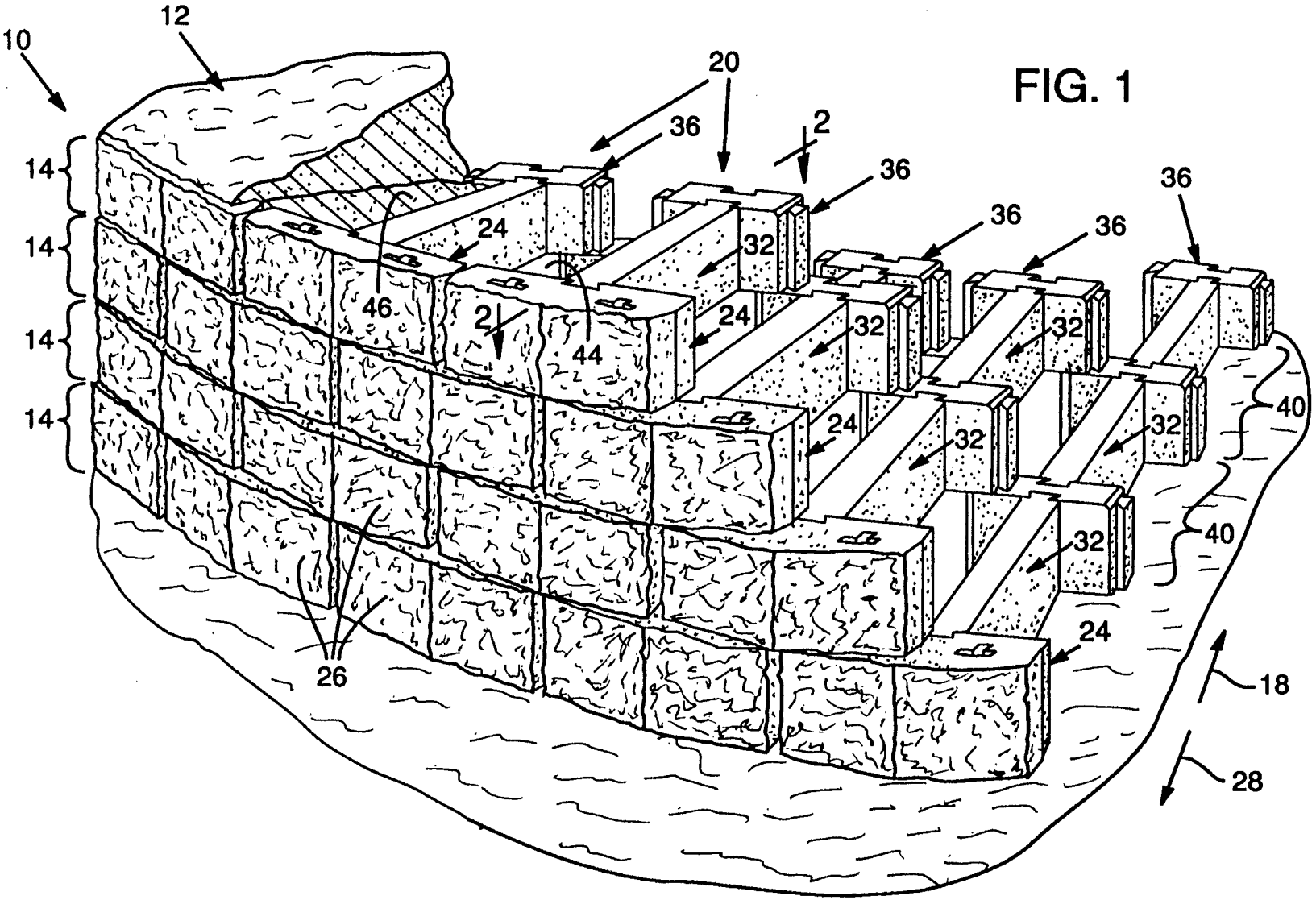
FIG. 1 is a perspective view of a retaining wall according to the present invention.

FIG. 1 shows a retaining wall 10 for retaining a sloped bank 12 against sliding and slumping. The wall 10 is formed of several vertically stacked courses or layers 14. Each layer 14 is generally horizontal and extends in a rearward direction 18 into the bank 12.

Figure 2:
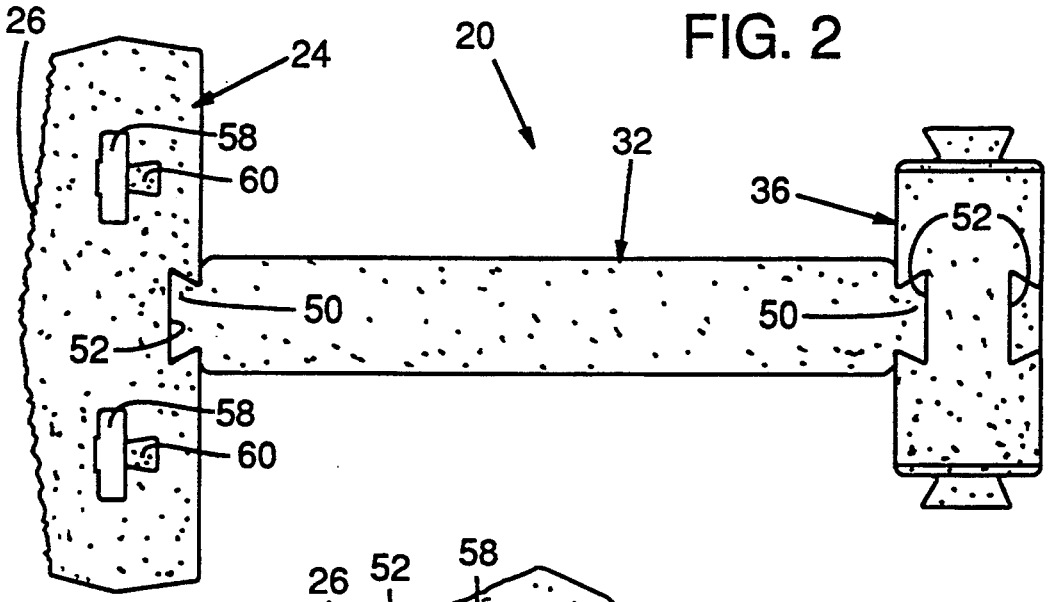
FIG. 2 is a top view of a subassembly of the embodiment of FIG. 1.

Each layer is formed of a row of side-by-side I-shaped subassemblies 20. Each subassembly typically includes at least three interlocked, vertically oriented planar blocks. As shown in FIG. 2, a veneer or face block 24 has a textured face surface 26 facing a forward direction 28 opposite the rearward direction, the forward direction being generally downslope. A trunk block 32 is attached to the rear of the face block 24 at a vertical medial junction thereon. The trunk block extends perpendicularly from the face block 24 in the rearward direction 18. A tail block 36 is attached to the rearward end of the trunk block 32 so that it is parallel to the face block 24, with the trunk block being attached to the tail block at a vertical medial junction.

For additional anchoring stability, particularly in the lower layers 14 of walls having several layers, the subassemblies 20 may be elongated in the rearward direction 18 by attaching one or more extension subassemblies 40. The lowest layer will extend into the slope a distance approximately equal to one-third of the final wall height. The extension subassembly 40 includes a tail block 36 attached perpendicularly to a trunk block 32 in a T-shaped arrangement as in a standard subassembly 20. In each extension subassembly 40, the trunk block 32 attaches to and extends perpendicularly from the center of the tail block 36 of the standard subassembly 20.

In the retaining wall 10 shown in FIG. 1, the subassemblies 20 are placed side by side so that their trunk blocks 32 are generally parallel and the face blocks 24 are positioned end-to-end in a continuous line. Thus, a pair of adjacent subassemblies defines a generally rectangular chamber 44 suitable for filling with backfill material 46 to provide stability and drainage. Each chamber 44 is defined at its sides by the trunk blocks of the respective subassemblies and at its front and rear by the face blocks and tail blocks of the respective subassemblies.

As further shown in FIG. 1, the successive layers 14 are staggered and may be set back by a small distance to create a slightly sloping wall face. Nonetheless, each face block 24 rests on the face blocks of the layer below and each tail block 36 rests on the tail blocks of the layer below, with each trunk block 32 being suspended above the chamber 44 below. The face blocks 24 are wider than the tail blocks 36 so that convex curved walls may be formed by bringing together adjacent tail blocks 36 closer than a parallel spacing would ordinarily dictate. To form a concave wall, the tail blocks are spaced apart wider than ordinarily dictated but are not spaced apart so far that each tail block 36 does not rest on the ends of the spaced apart tail blocks of the layer below. If a more sharply concave wall is desired, separate tail blocks may be added to support any unsupported members.

As shown in FIG. 2, the face block 24, trunk block 32 and tail block 36 are assembled to provide an interconnected I-shaped subassembly 20. In the interconnected state, the components of the subassembly may not be disconnected or separated in any lateral direction without breakage. The blocks are not merely held in place by frictional forces and the presence of adjacent unconnected blocks. Each block is securely mechanically engaged to at least one other adjacent block.

The blocks are interconnected by dovetail joints so that they may be separated only by vertically sliding one block with respect to the attached block. A dovetail joint may be formed in any of a wide variety of geometries as long as the blocks are connected against lateral separation. Dovetail joints generally have a male key or tongue 50 that mates with a female slot or groove 52. Typically, the tongue is wider at some position toward its free end than at another position closer to its root. The female groove 52 is configured to closely conform to the male shape. In the preferred embodiment, the face block 24 and tail block 36 define the vertical grooves 52, which are generally trapezoidal, with the face being wider than the aperture at the surface of each block. Compatible male tongues 50 are integrally formed on the ends of the trunk block 32, with the free end being wider than the root.

Figure 3:
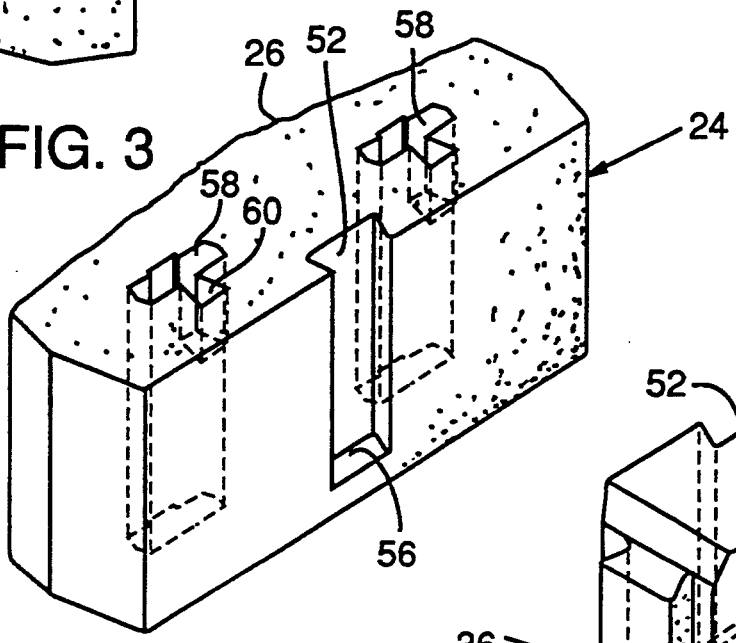
FIG. 3 is a perspective view of a face block of the embodiment of FIG. 1.

FIG. 3 shows the face block 24 with the groove 52 only partially bisecting the block. The groove does not entirely pass through the block, but terminates at a sloped end surface 56 that faces generally upward and rearwardly of the block. Thus, the lower portion of the block is solid and unbroken by the groove, thereby increasing the strength of the block and decreasing the risk of breakage at the groove 52.

The face block 24 further includes alignment channels 58 defining oblong bores passing vertically through the entire block. Each alignment channel includes a rear pocket 60 in parallel communication with the alignment channel 58 and extending to a limited depth. An alignment pin (not shown) may be inserted in the channel 58 in the forward oblong portion or in the rear pocket 60 to upwardly protrude and engage the alignment channels 58 of a face block 24 in the overlaying layer of blocks. The alignment pin resides in the front portion of the alignment channel 58 if zero setback is desired, and within the rear pocket 60 to achieve a stepped setback. The alignment holes are generally centered on points $\frac{1}{4}$ and $\frac{3}{4}$ of the distance along the length of the face block 24. In alternative embodiments, the alignment channels 58 may be used to retain vertical reinforcing bars passing vertically through several layers of the wall. In addition, the alignment channels 58 are elongated to provide lateral accommodation for block offset in curved walls with setback.

Figure 4:
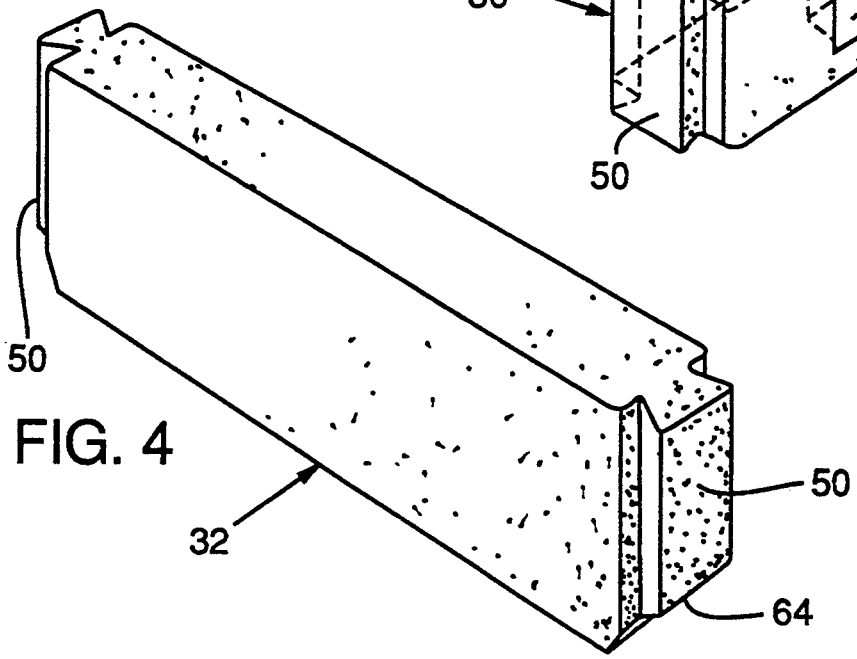
FIG. 4 is a perspective view of a trunk block of the embodiment of FIG. 1.

FIG. 4 shows the trunk block 32 with a male tongue at each end of the block. Each tongue has a sloped lower end 64 corresponding to the end surface 56 of the female groove 52. The tongue 50 does not extend the length of the block, but stops at the sloped end to permit the trunk block 32 and face block 24 to be interconnected to provide flush top and bottom surfaces.

Figure 5:
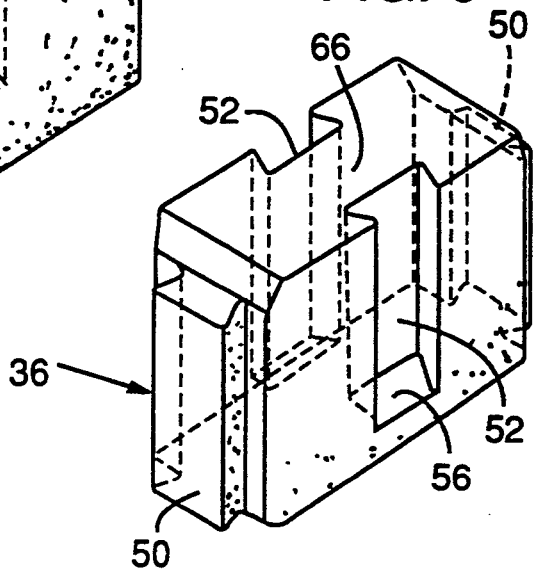
FIG. 5 is a perspective view of a tail block of the embodiment of FIG. 1.

FIG. 5 shows the tail block 36 with a male tongue 50 formed on each end to provide optional lateral attachment to the blocks, and with a female groove 52 centrally defined on each face according to the configuration of the face block 24. The grooves 52 are oriented back-to-back and spaced apart by a solid web 66 of block material to provide adequate strength.

The tongues 50 and grooves 52 are all similarly tapered along their vertical lengths so that each dovetail joint is secured against excess motion and slippage by the tongue 50 being wedged into the groove. In a maximum material condition, the trunk block 32 may ride slightly above a flush alignment with the adjoining blocks: in a minimum material condition, the end surface 56 of the groove 52 and the sloped end 64 of the tongue 50, which are ordinarily spaced apart in nominal conditions, will abut to prevent the trunk block from being excessively below an aligned level.

EXAMPLE

In the preferred embodiment, the face block 24 has a height of 7 ⅝ inches, a width of 17 ¾ inches and a thickness varying between 4 5/16 and 5 13/16 inches. The dovetail groove 52 has a depth of 1 1/16 inches, a width of 2 3/32 inches at its widest point and 1 9/16 inches at its narrowest point, with the wedge taper enlarging these dimensions by ¼ inch at the top surface of the block. The male tongues 50 are similarly dimensioned.

The trunk block is 24 inches long overall, 3 ⅝ inches wide and the same height as the face block. Each tongue runs 6 ⅝ inches from the top of the block at the root of the tongue, with this dimension being reduced by ⅜ inch at the free end of each tongue due to the angle of the sloped end 64. The overall length may be shorter or longer, and may extend up to four feet or more to provide added depth anchoring in the slope. In addition, the tail block may be inverted and substituted to provide an alternate length trunk block.

The tail block 36 is configured similarly to the trunk block, but with a length of 11 ⅝ inches overall and with the back-to-back dovetail grooves formed therein as illustrated. As in the face block 24, additional grooves may be added at the one-quarter and three-quarter points along the face of the block to provide for alternate construction arrangements. For instance, trunk blocks extending from proximate quarter points of adjacent face blocks may connect to a common tail block having joints at the quarter points to provide a laterally connected structure.

Having illustrated and described the principles of my invention by what is presently a preferred embodiment, it should be apparent to those skilled in the art that the illustrated embodiment may be modified without departing from such principles. For instance, although the invention is preferably constructed using concrete blocks, other materials may be substituted. Also, the blocks may be assembled as a free-standing wall with face blocks on opposite sides and interconnected by trunk blocks or tail blocks to determine the thickness of the wall. The dovetail joint elements may be reversed so that male elements replace the illustrated female elements, and vice versa. The retaining wall may be constructed in a stepped arrangement with treads attached to provide a stairway. The face blocks alone may attach to anchors horizontally bored into a slope, or to any compatible anchor mounted to a vertical surface such as a building facade.

I claim as my invention not only the illustrated embodiments, but all such modifications, variations and equivalents thereof as come within the spirit and scope of the following claims.

I claim:

1. A modular building block system for building a retaining wall comprising a plurality of blocks each having a dovetail connector element for interlocking with a complementary dovetail element of another of the blocks, the blocks including:

a face block including a single face block dovetail element, the face block having an exposed face surface and an opposed rear surface including the dovetail element;

an elongated trunk block having a first trunk block dovetail element at a first end, and a second trunk block dovetail element at an opposite end, at least said first trunk block dovetail element being complementary in size and shape to the face block dovetail element for interlocking therewith; and a tail block having opposed first and second surfaces, with first and second tail block dovetail elements formed one on each of the first and second surfaces, at least said first tail block dovetail element being complementary in size and shape to the second trunk block dovetail element and the second tail block dovetail element being complementary in size and shape to the first trunk block dovetail element, such that the blocks may be assembled to form subassemblies each having a trunk block attached by a dovetail element to the rear of the face block, the trunk block extending rearwardly from the rear of the face block, with a tail block attached by a dovetail element to the opposite end of the trunk block, and such that additional trunk blocks and tail blocks may be optionally attached by dovetail elements to extend rearwardly from the tail block to form elongated subassemblies of variable selectable lengths.

2. The system of claim 1 wherein the tail block is substantially the same height as the face block.

3. The system of claim 1 wherein the trunk block is substantially the same height as the face block.

4. The system of claim 1 wherein both the trunk block and the tail block are the same height as the face block.

5. The system of claim 1 wherein the first and second dovetail elements of the trunk block are of the same gender as each other, and the first and second dovetail elements of the tail block are of the same gender as each other, and of opposite gender from the dovetail elements of the trunk block.

6. The system of claim 1 wherein the tail blocks have third and fourth opposed surfaces having third and fourth dovetail elements of the same gender and opposite in gender to the first and second dovetail elements of the tail block, such that the tail block optionally can be interconnected with the face block.

7. The system of claim 1 wherein the face block front face is uninterrupted by a dovetail element.

8. The system of claim 1 wherein the face block has a greater width than the trunk block and the tail block.

9. The system of claim 1 wherein the tail block has a greater width than the trunk block.

10. A retaining wall comprising:

a plurality of interconnected blocks, each having a dovetail element connected to a dovetail element of another of the blocks, the interconnected blocks being arranged in generally horizontal layers including a second layer above a first layer, each layer having a predetermined height, each of the blocks having a height substantially equal to the height of the layer in which it resides, each layer having at least one exposed face and extending rearwardly from the exposed face to a predetermined depth, the depth of the first layer being greater than the depth of the second layer, such that the wall is stabilized against toppling; and wherein each of the first and second layers includes a plurality of subassemblies of blocks, each subassembly having an exposed face block and a rearmost tail block spaced apart rearwardly from the face block and connected thereto by an intervening block.

11. The wall of claim 10 wherein each subassembly of the first layer includes more blocks than each subassembly of the second layer.

12. The wall of claim 10 wherein each subassembly of the first layer includes a trunk block connecting the face block to the tail block.

13. The wall of claim 10 wherein each subassembly of the first layer includes a plurality of blocks interconnecting the face block and the rearmost tail block.

14. The wall of claim 12 wherein the face block has a first width, and the trunk block and the tail block have respective widths less than the first width.

15. A retaining wall subassembly comprising a plurality of blocks interconnected at dovetail joint elements of the blocks, the subassembly having:

a face block having an exposed front face defining the width of the face block and a rear face;

a trunk block connected at one end to the rear face of the face block and extending rearwardly from the face block to an opposite end, the trunk block having a width less than the width of the face block;

a tail block connected to the opposite end of the trunk block at a first dovetail joint element on a front face of the tail block, the tail block having width greater than the width of the trunk block and a rear face defining a second dovetail joint element facing away from the trunk block for optional connection to a second trunk block, such that the subassembly may be extended rearwardly to any desired depth by a series of trunk block-tail block interconnections.

16. The subassembly of claim 15 wherein the width of the tail block is less than the width of the face block, such that multiple subassemblies may be positioned side-by-side in a curved line to form a horizontally convex wall.

17. The subassembly of claim 15 wherein the interconnected face, trunk and tail blocks define a three-sided backfill chamber on each side of the trunk block for receiving backfill material on each side of the trunk block between the face block and the tail block.

18. The subassembly of claim 15 wherein the tail block and the face block are of the same height.

19. The subassembly of claim 18 wherein the trunk block and the face block are of the same height.

* * * * *